United States Patent [19]

Whitehead

[11] Patent Number: 4,554,692

[45] Date of Patent: Nov. 26, 1985

[54] ADJUSTABLE BOX SPRING RETAINER BRACKET

[75] Inventor: Larry W. Whitehead, Lexington, N.C.

[73] Assignee: Leggett & Platt, Incorporated, Carthage, Mo.

[21] Appl. No.: 681,500

[22] Filed: Dec. 13, 1984

[51] Int. Cl.[4] ..... A47C 19/02

[52] U.S. Cl. ..... 5/411; 5/193; 5/207

[58] Field of Search ..... 5/193, 411, 207, 238, 5/200, 201, 400

[56] References Cited

U.S. PATENT DOCUMENTS

| | | | |
|---|---|---|---|
| Re. 29,029 | 11/1976 | Harris | 5/181 |
| Re. 29,611 | 4/1978 | Lawrence | 5/238 |
| 683,803 | 10/1901 | Ruebusch . | |
| 2,544,274 | 3/1951 | Moeller | 5/185 |
| 3,744,068 | 7/1973 | Harris | 5/181 |
| 3,757,361 | 9/1973 | Harris et al. | 5/200 R |
| 3,869,738 | 3/1975 | Lawrence | 5/238 |
| 3,984,884 | 10/1976 | Spitz | 5/238 |
| 4,297,754 | 11/1981 | Zuniga | 5/411 |
| 4,458,371 | 7/1984 | Whitehead | 5/411 |

*Primary Examiner*—Alexander Grosz
*Attorney, Agent, or Firm*—Wood, Herron & Evans

[57] ABSTRACT

An adjustable retainer bracket for retaining a bedding foundation such as box springs on a pedestal bed base having spaced side rails and cross slats connected between the side rails, includes a retainer plate having a horizontal web connected to downwardly extending vertical side legs, and spaced locator holes and a keyhole formed in the horizontal web. The retainer plate is mounted atop a cross slat by placing the keyhole over an upstanding shouldered rivet fixed to the cross slat. The vertical legs of the retainer plate extend downwardly and straddle the cross slat to prevent rotation of the retainer plate relative to the cross slat. A spring locking member having a locking pin at one end is mounted to the underside of the cross rail so that the locking pin extends upwardly through one of the spaced locator holes formed in the retainer plate. The position of the retainer plate along the cross rail may be adjusted by withdrawing the locking pin from one locator hole, sliding the retainer plate along the slat and then fitting the locking pin into another locator hole in the retainer plate.

5 Claims, 4 Drawing Figures

ADJUSTABLE BOX SPRING RETAINER BRACKET

BACKGROUND OF THE INVENTION

This invention relates to mounting brackets for pedestal bed bases, and, more particularly, to an adjustable retainer bracket for supporting box springs or bedding foundations of varying widths on a pedestal bed base.

Pedestal bed bases generally comprise a pair of spaced side rails connected to each end to an end rail. A center rail is mounted between the end rails parallel to the sides rails to provide additional support for the pedestal base from end to end. To provide lateral support of the box springs atop the bed base, three or more cross slats are connected between the side rails.

Prior art cross slats generally comprise an angle iron including a horizontal leg formed with two or more spaced bores at each end, connected to a vertical leg having cut-outs at each end. The cut-outs are adapted to fit within notches formed in the side rails to mount the angle iron to each side rail. An L-shaped retainer bracket is then mounted atop the angle iron at each end. The retainer brackets each include a horizontal surface, formed with an elongated slot, connected to an upright vertical surface. The retainer plate is placed in the desired position along the angle iron so that its slot aligns with the bores formed in the angle iron, and bolts are then inserted through the slot into each bore where they are secured by nuts. The position of the retainer plate may be adjusted along the end of the angle iron by loosening the nuts and sliding the retainer plate along the slot to the desired position to accommodate box springs of different widths.

One problem with prior art retainer brackets is that the nuts and bolts used to mount the retainer plate atop the angle irons may become loosened during use of the bed. Since the retainer plate is mounted flush with the horizontal surface of the angle iron, it is free to rotate relative to the angle iron and thus permit the box spring for foundation to move out of position on the bed base. In addition, hardware such as nuts and bolts are easily lost when the bed frame is taken apart for moving or storage.

SUMMARY OF THE INVENTION

It is therefore among the objects of this invention to provide a retainer bracket for mounting box springs or bedding foundations atop a pedestal bed base which requires no nuts, bolts or other removable hardware, which does not permit rotation of the foundations atop the bed frame, and which is adjustable to accommodate foundations or box springs of varying width.

The retainer bracket which accomplishes these objectives is adapted to mount atop an L-shaped cross rail or slat having a horizontal leg connected to a vertical leg which extends between and mounts to the side rails of a pedestal bed base. An upstanding shouldered rivet is mounted to the horizontal leg of the slat near each end, and a bore is formed in the horizontal leg between the rivet and its outer end. A spring locking member having an upright locking pin at one end mounts to the underside of the horizontal leg of the slat so that the locking pin extends through the bore therein.

A retainer plate is adapted to mount atop each end of the slat to retain the box spring or foundation in position on the pedestal bed base. The retainer plate is formed with a web having a horizontal surface and vertical legs mounted to the side edges of the web. The vertical legs extend upwardly from the horizontal surface of the web forming an uppermost, box spring or foundation supporting surface, and then bend downwardly, perpendicular to the horizontal surface. The horizontal surface of the web is formed with a keyhole slot and plurality of spaced locator holes. An upright end section extends upwardly from one end of the horizontal surface of the web and is adapted to engage the side of the box spring or foundation.

The retainer plate is mounted atop the slat by extending the rivet mounted to the slat through the keyhole and fitting the locking pin of the spring locking member into one of the spaced locator holes in the retainer plate. The vertical legs of the retainer plate extend downwardly along the side edges of the slat and capture its horizontal leg therebetween to prevent rotation of the retainer plate relative to the slat. The position of the retainer plate along the slat is adjusted by bending the spring locking member downwardly so that its locking pin disengages a locator hole. The retainer plate is slid to the desired position along the slat, with the rivet moving along the keyhole, and the spring locking member is then released to extend its pin into another locator hole of the retaining plate. When mounted atop the slat, the vertical legs of the retainer plate at their uppermost portion extend above the horizontal plane of the top of the shouldered rivet and locking pin of the spring locking member to provide a supporting surface for the box spring or foundation.

In contrast to prior art retainer brackets, the retainer bracket of this invention requires no removable hardware such as nuts and bolts for mounting the retainer plate upon the slat. The rivet and spring locking member are fixed to the slats and permit easy adjustment of the position of the retainer plate along the slat to accommodate box springs or foundations of varying width. In addition, the vertical legs of the retainer plate capture the horizontal leg of the slats therebetween so as to prevent rotation of the retainer plate relative to the slat and assure that the box spring or foundation is maintained in position atop the bed frame.

DESCRIPTION OF THE DRAWINGS

The structure, operation and advantages of this invention will become further apparent upon consideration of the following description taken in conjunction with the accompanying drawings, wherein.

DETAILED DESCRIPTION OF THE INVENTION

Figure 1:
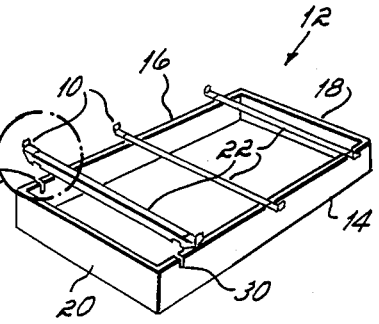
FIG. 1 is a perspective view of a pedestal bed base including the retainer bracket of this invention.

Referring now to the drawings, the adjustable retainer bracket 10 of this invention is intended to mount box springs (not shown) atop a pedestal bed base 12 having spaced side rails 14, 16 connected to end rails 18, 20. As shown in FIG. 1, three angle irons or slats 22 extend between the side rails 14, 16 for supporting the box spring or foundation atop the bed base 12. Each slat 22 includes a horizontal leg 24 connected to a vertical leg 26. The vertical leg 26 is formed with a cut-out 28 at each end which is adapted to fit within notches 30 formed in each side rail 14, 16 for mounting the slats 22 to the side rails 14, 16.

Figure 2:
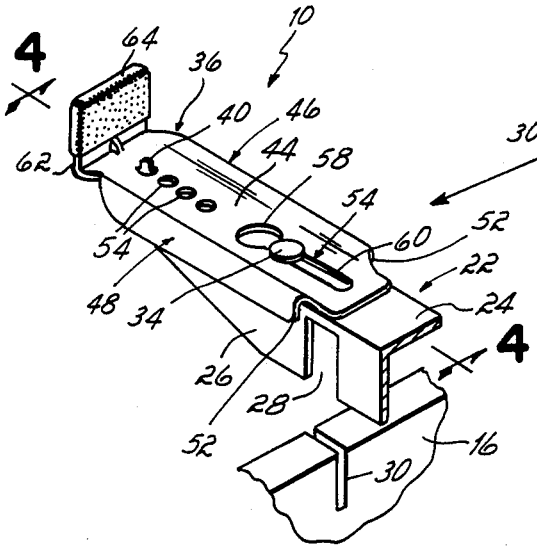
FIG. 2 is a partial perspective view of the retainer bracket of this invention mounted to a cross slat prior to mounting of the slat to the side rail of the pedestal bed base of FIG. 1.
Figure 3:
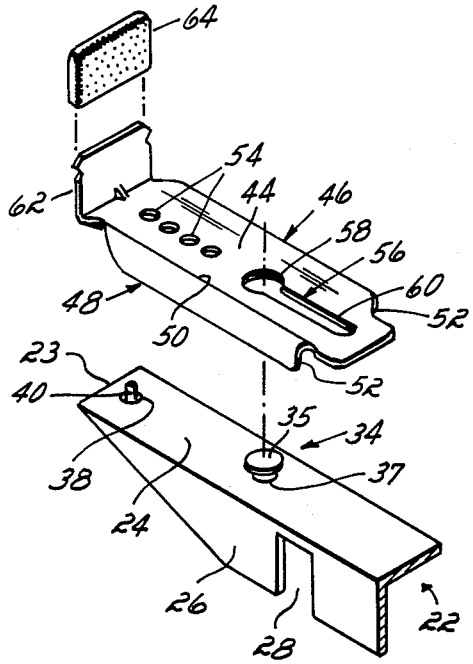
FIG. 3 is an exploded perspective view of the retainer bracket shown in FIG. 2.
Figure 4:
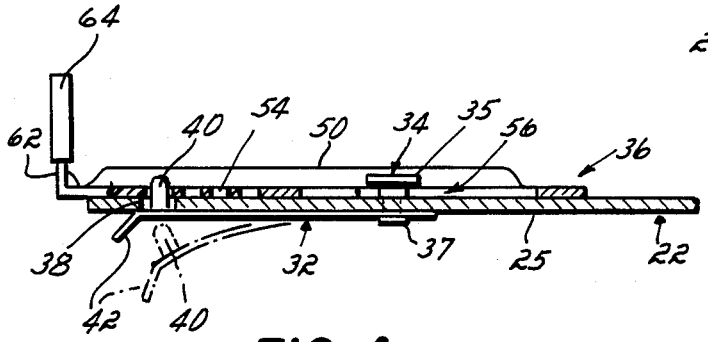
FIG. 4 is a partial cross sectional view taken generally along line 4—4 of FIG. 2 which shows the operation of the spring locking member in phantom lines.

The retainer bracket 10 of this invention includes a spring locking member 32 and a rivet 34 which are adapted to mount a metal retainer plate 36 to each end of the horizontal leg 24 of slat 22. Only one end of a slat 22 is shown in FIGS. 2–4, but it should be understood that an identical retainer bracket 10 is mounted to the other end of slat 22 as illustrated in FIG. 1.

The rivet 34 is mounted to the horizontal leg 24 of slat 22 near its outer end 23. The rivet 34 is preferably a shouldered rivet having a head section 35, and a stem section 37 of smaller diameter connected to slat 22. A bore 38 is formed in the slat 22 between the rivet 34 and its outer end 23. The spring locking member 32 is a flat section preferably formed of spring steel having an upright locking pin 40 and a downwardly extending tab 42 at one end. The spring locking member 32 is mounted to the underside 25 of the horizontal leg 24 of slat 22 by the rivet 34 so that the upright locking pin 40 extends through the bore 38 in slat 22.

The retainer plate 36 includes a web 44 having a horizontal surface and vertical legs 46, 48 extending longitudinally along the side edges of web 44. The vertical legs 46, 48 extend upwardly from the horizontal web 44 each forming a curved uppermost edge 50 which then bends vertically downwardly and below the horizontal web 44 forming a lip 52. A plurality of spaced locator holes 54 are formed in the horizontal web 44 near one end, and a keyhole 56 having a bore 58 connected to an elongated slot 60 is formed in the opposite end of the horizontal web 44. The diameter of the keyhole bore 58 is slightly greater than the diameter of the head section 35 of rivet 34, and the keyhole slot 60 has a transverse dimension less than the head section 35 diameter but greater than the diameter of the stem section 37 of rivet 34. An upright end surface 62 is mounted at one end of the horizontal web 44 adjacent the locator holes 54 which is adapted to receive a plastic cover or cap 64.

The retainer plate 36 is mounted atop the slat 22 by placing the keyhole bore 58 over the head section 53 of the shouldered rivet 34 and moving the retainer plate 36 along the slat 22, with rivet 54 sliding within keyhole slot 60, so that the locking pin 40 of the spring locking member 32 extends within one of the locator holes 54 of the retainer plate 36. The retainer plate 36 is prevented from lifting upwardly from the slat 22 by the engagement of the retainer plate 36 with the head section 58 of rivet 54 along the keyhole slot 60. The position of the retainer plate 36 is adjustable along the slat 22 by first bending the spring locking member 32 downwardly using tab 42, as shown in phantom in FIG. 4, so that the locking pin 40 is withdrawn from a locator hole 54 and retainer plate 36. The retainer plate 36 is slid to the desired position along the slat 22, with the rivet 34 moving along the keyhole slot 60, and the spring locking member 32 is then released so that its locking pin 40 extends within another locator hole 54 in the retainer plate 36.

As shown in FIG. 2, the lower lip 52 of the vertical legs 46, 48 of retainer plate 36 extend downwardly below the side edges of slat 22 when the retainer plate 36 is mounted atop the slat 22. This captures the horizontal leg 24 of slat 22 between the vertical legs 46, 48 to prevent rotational movement of the retainer plate 36 relative to the slat 22 so that the box springs are retained in place atop the bed base 12. In addition, the uppermost edge 50 of vertical legs 46, 48 extends above the horizontal plane formed by the head section 35 of rivet 34 and the top of locking pin 40 and thus provides a box spring engaging surface which permits the box springs to be placed atop and removed from the bed base 12 without engaging the rivet 54 or locking pin 40.

While the invention has been described with reference to a preferred embodiment, it will be understood by those skilled in the art that various changes may be made and equivalents may be substituted for elements thereof without departing from the scope of the invention. Therefore, it is intended that the invention not be limited to the particular embodiment disclosed as the best mode contemplated for carrying out this invention, but that the invention will include all embodiments falling within the scope of the appended claims.

I claim:

1. An adjustable retainer bracket for retaining bedding foundations on a pedestal bed base, said pedestal bed base including spaced side rails and at least one cross slat mounted to said side rails having a horizontal leg formed with side edges and a bore at each end, said adjustable retainer bracket comprising:

a retainer plate formed with a horizontal web, a pair of spaced vertical legs connected to each side of said horizontal web, an upright end section connected to one end of said horizontal web, and a plurality of spaced locator holes and a keyhole formed in said horizontal web;

an upstanding shouldered rivet mounted to said horizontal leg of said slat;

a spring locking member having a locking pin at one end, said spring locking member being mounted to the underside of said horizontal leg of said slat so that said locking pin extends through said bore therein;

said retainer plate being mounted upon said slat so that said upstanding rivet extends through said keyhole and said locking pin of said spring locking member extends through one of said locator holes to position said retainer plate along said slat, said vertical legs of said retainer plate extending downwardly and capturing said horizontal leg of said slat therebetween to prevent rotation of said retainer plate relative to said slat.

2. The retainer bracket of claim 1 in which said vertical legs of said retainer plate extend upwardly from said horizontal web forming an uppermost end portion, and then downwardly perpendicular to and below the side edges of said horizontal web, said vertical legs extending downwardly on opposite sides of said horizontal leg of said slat to prevent rotation of said retainer plate relative to said slat.

3. The retainer bracket of claim 2 in which said uppermost portion of said vertical legs extends above said shouldered rivet and said locking pin upon mounting of said retainer plate atop said slat.

4. The retainer bracket of claim 1 further including a plastic cap adapted to fit over said end section of said retainer plate and engage the box springs.

5. The retainer bracket of claim 1 in which said shouldered rivet is formed with a stem section and a head section of larger diameter, said keyhole being formed with a slot connected to a bore, said keyhole slot having a transverse dimension greater than the diameter of said stem section of said rivet and said keyhole bore having a diameter greater than the diameter of said head section of said rivet, said head section of said rivet being insertable through said bore and said stem section being slidable along said keyhole slot for moving said retainer plate atop said slat, said spring locking member being bendable to withdraw said locking pin from one of said locator holes to permit movement of said retainer plate to a desired position of adjustment, said spring locking member thereafter being releasable to extend said locking pin through another of said locator holes to secure said retainer plate in said position of adjustment.

* * * * *

UNITED STATES PATENT AND TRADEMARK OFFICE

CERTIFICATE OF CORRECTION

PATENT NO. : 4,554,692

DATED : November 26, 1985

INVENTOR(S) : Larry W. Whitehead

It is certified that error appears in the above-identified patent and that said Letters Patent is hereby corrected as shown below:

Column 1, line 11, delete "to" (first occurrence) and insert -- at --

Column 1, line 41, "for" should read as -- or --

Signed and Sealed this

*Thirtieth* Day of *September 1986*

[SEAL]

*Attest:*

DONALD J. QUIGG

*Attesting Officer*

*Commissioner of Patents and Trademarks*